US011599059B2

(12) United States Patent
Katagiri et al.

(10) Patent No.: US 11,599,059 B2
(45) Date of Patent: Mar. 7, 2023

(54) IMAGE FORMING APPARATUS WITH CONDENSATION CONTROL

(71) Applicant: CANON KABUSHIKI KAISHA, Tokyo (JP)

(72) Inventors: Shinji Katagiri, Kanagawa (JP); Shuichi Tetsuno, Kanagawa (JP); Keisuke Ishizumi, Kanagawa (JP); Yuichiro Inaba, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/086,021

(22) Filed: Oct. 30, 2020

(65) Prior Publication Data

US 2021/0141337 A1 May 13, 2021

(30) Foreign Application Priority Data

Nov. 13, 2019 (JP) ..... JP2019-205594

(51) Int. Cl.

| | |
|---|---|
| ***G03G 21/20*** | (2006.01) |
| ***G03G 15/16*** | (2006.01) |
| ***G03G 21/00*** | (2006.01) |

(52) U.S. Cl.

CPC ..... *G03G 21/203* (2013.01); *G03G 15/1605* (2013.01); *G03G 21/0005* (2013.01); *G03G 21/0041* (2013.01)

(58) Field of Classification Search

CPC ..... G03G 15/1605; G03G 15/162; G03G 21/203; G03G 21/0064; G03G 21/0094

See application file for complete search history.

(56) References Cited

U.S. PATENT DOCUMENTS

2010/0074646 A1* 3/2010 Miyahara ..... G03G 15/168 399/99
2013/0051838 A1* 2/2013 Takazawa ..... G03G 15/0194 399/101

(Continued)

FOREIGN PATENT DOCUMENTS

JP 2000155447 A 6/2000
JP 2010134321 A 6/2010

(Continued)

OTHER PUBLICATIONS

English transation of JP 2000-155447 (Year: 2000).*

*Primary Examiner* — Arlene Heredia
(74) *Attorney, Agent, or Firm* — Canon U.S.A., Inc., IP Division

(57) ABSTRACT

An image forming apparatus includes an image bearing member, a belt, a development unit having a development member in contact with the image bearing member to develop an electrostatic latent image formed on the image bearing member using toner, and a collection unit having a contacting member in contact with the belt to collect toner remaining on the belt adjacent to the contacting member. If condensation is detected inside the image forming apparatus, the image forming apparatus performs predetermined control to separate the development member from the image bearing member and drive the belt in such a manner that the belt moves at a second surface speed different from a first surface speed while driving the image bearing member in such a manner that the image bearing member rotates at the first surface speed in a state where the image bearing member is in contact with the belt.

13 Claims, 9 Drawing Sheets

(56) References Cited

U.S. PATENT DOCUMENTS

| | | | | |
|---|---|---|---|---|
| 2016/0033922 | A1* | 2/2016 | Nodera | G03G 21/08 399/128 |
| 2019/0079450 | A1* | 3/2019 | Kimura | G03G 15/04036 |

FOREIGN PATENT DOCUMENTS

| | | | |
|---|---|---|---|
| JP | 2014081466 | A | 5/2014 |
| JP | 2018060177 | A | 4/2018 |

* cited by examiner

IMAGE FORMING APPARATUS WITH CONDENSATION CONTROL

BACKGROUND

Field

The present disclosure relates to a color image forming apparatus using an electrophotographic process or the like.

Description of the Related Art

As an electrophotographic image forming apparatus, there is known a configuration of a tandem-type image forming apparatus including a plurality of image forming units each arranged in a movement direction of an intermediate transfer member, such as an intermediate transfer belt, or a conveyance belt that bears and conveys a transfer material. Each of the image forming units for respective colors includes a drum-shaped photosensitive member (hereinafter referred to as a photosensitive drum) as an image bearing member. Toner images of the respective colors borne on the photosensitive drums of the respective colors are transferred onto the transfer material, such as paper or an overhead projector (OHP) sheet, conveyed by a transfer material conveyance belt, or are transferred onto the transfer material after being first transferred onto the intermediate transfer belt, and then the toner images are fixed onto the transfer material by a fixing unit.

Now, the image forming apparatus may be subjected to occurrence of condensation in the apparatus due to a change in an office environment in which the image forming apparatus is set up. For example, in a case where the apparatus is set up in an office under a cold condition, when the temperature around the apparatus increases due to operation of an air conditioner, the temperature inside the image forming apparatus follows a change in the outside temperature with a time lag of approximately several tens of minutes to several hours therefrom. During that, a great temperature difference is generated between the temperatures inside and outside the image forming apparatus. When air outside the apparatus is introduced into the apparatus by a fan or the like in a case where there is a great difference between the temperatures inside and outside the image forming apparatus, condensation may form on an exposure device, a photosensitive drum, and/or the intermediate transfer member due to the temperature difference between the air and the inside of the image forming apparatus. The occurrence of the condensation may cause an image defect such as a missing portion in the image and fogging.

Japanese Patent Application Laid-Open No. 2014-81466 discusses a configuration of an image forming apparatus capable of performing an operation for resolving condensation when it is determined that condensation has occurred in the apparatus. More specifically, Japanese Patent Application Laid-Open No. 2014-81466 discusses a configuration that performs control of supplying toner from a development unit for forming a toner image to a photosensitive drum, allowing the toner to absorb moisture attached to a surface of the photosensitive drum, and then collecting the toner using a cleaning unit in contact with the photosensitive drum.

However, in an image forming apparatus employing a structure unequipped with the cleaning unit in contact with the photosensitive drum, i.e., a so-called cleaner-less structure, an image defect may occur if the control according to Japanese Patent Application Laid-Open No. 2014-81466 is performed. More specifically, if the control according to Japanese Patent Application Laid-Open No. 2014-81466 is performed on the cleaner-less structure, the toner that is supplied from the development unit to the photosensitive drum and has absorbed the moisture attached to the surface of the photosensitive drum is kept remaining on the photosensitive drum because the cleaning unit is not provided. Then, the toner remaining on the photosensitive drum with the moisture absorbed therein may move from the photosensitive drum to the transfer material conveyed by the conveyance belt or the intermediate transfer belt, thereby ending up visibly emerging as the image defect.

SUMMARY

Under these circumferences, the present disclosure is directed to preventing or reducing the occurrence of the image defect due to the condensation forming in the image forming apparatus having the cleaner-less structure.

According to an aspect of the present disclosure, an image forming apparatus includes an image bearing member configured to bear a toner image on the image bearing member, a belt configured to be movable, wherein the belt forms a transfer portion in contact with the image bearing member, a development unit including a development member in contact with the image bearing member and configured to develop an electrostatic latent image formed on the image bearing member using toner, wherein the toner image borne on the image bearing member is transferred onto the belt at a position where the transfer portion is formed, and toner from the toner image remaining on the image bearing member after passing through the position where the transfer portion is collected by the development unit, a collection unit disposed downstream of a position where the image bearing member and the belt are in contact with each other in a movement direction of the belt, wherein the collection unit includes a contacting member in contact with the belt and is configured to collect toner remaining on the belt adjacent to the contacting member, a detection unit configured to detect at least one of an environment inside the image forming apparatus and an environment around a location at which the image forming apparatus is set up, and a control unit configured to perform control, wherein, in a case where condensation is determined as having occurred inside the image forming apparatus based on a result of detection by the detection unit, the control unit performs predetermined control to separate the development member from the image bearing member and drive the belt in such a manner that the belt moves at a second surface speed different from a first surface speed while driving the image bearing member in such a manner that the image bearing member rotates at the first surface speed in a state where the image bearing member is in contact with the belt.

Further features of the present disclosure will become apparent from the following description of exemplary embodiments with reference to the attached drawings.

DESCRIPTION OF THE EMBODIMENTS

In the description below, representative exemplary embodiments of the present disclosure will be described in detail by way of example with reference to the drawings. However, dimensions, materials, shapes, and a relative layout of components that will be described in the exemplary embodiments below may be changed as appropriate based on the configuration of an apparatus to which the present disclosure is applied and various kinds of conditions. Thus, they are not intended to limit the scope of the present disclosure unless otherwise specifically indicated.

[Configuration of Image Forming Apparatus]

Figure 1:
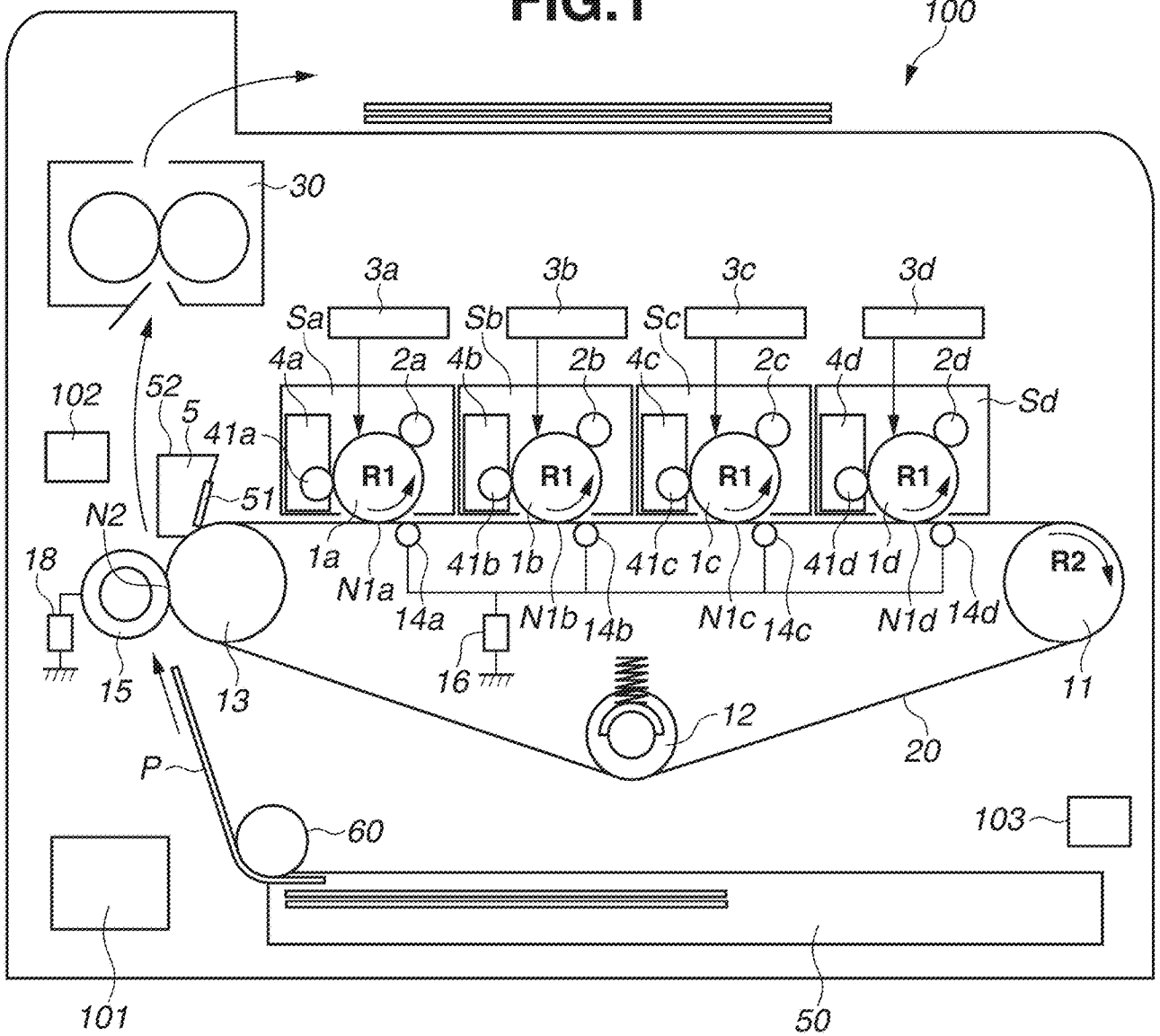
FIG. 1 is a schematic cross-sectional view illustrating a configuration of an image forming apparatus according to a first exemplary embodiment.

FIG. 1 is a schematic cross-sectional view illustrating a configuration of an image forming apparatus 100 according to a first exemplary embodiment. As illustrated in FIG. 1, the image forming apparatus 100 according to the present exemplary embodiment is a so-called tandem-type image forming apparatus including a plurality of image forming units Sa to Sd. The first image forming unit Sa, the second image forming unit Sb, the third image forming unit Sc, and the fourth image forming unit Sd form images using toner of respective colors of yellow (Y), magenta (M), cyan (C), and black (Bk). The four image forming units Sa to Sd are arranged in a row at predetermined intervals, and respective configurations of the image forming units Sa to Sd are substantially the same in many parts except for the color of the toner contained therein. Thus, in the description below, the image forming apparatus 100 according to the present exemplary embodiment will be described with reference to the first image forming unit Sa.

The first image forming unit Sa includes a photosensitive drum 1*a*, which is a drum-shaped photosensitive member, a charging roller 2*a*, which is a charging member, an exposure unit 3*a*, and a development unit 4*a*. The photosensitive drum 1*a* is an image bearing member that bears a toner image thereon, and is rotationally driven at a predetermined circumferential speed (process speed) in a direction indicated by an illustrated arrow R1 (counterclockwise direction) by receiving a driving force from a driving source (not illustrated). The image forming units Sa to Sd according to the present exemplary embodiment have so-called cleaner-less structures unequipped with cleaning members in contact with the photosensitive drums 1*a* to 1*d*, respectively.

When a controller 101 as a control unit receives an image signal, the controller 101 controls various kinds of units, by which an image forming operation is started. The photosensitive drum 1*a* is rotationally driven by receiving the driving force from the driving source (not illustrated). In the course of the rotation, the photosensitive drum 1*a* is evenly subjected to charging processing by the charging roller 2*a* to have a predetermined polarity (negative polarity in the present exemplary embodiment) and a predetermined potential, and is exposed based on the image signal by the exposure unit 3*a*. As a result, an electrostatic latent image corresponding to a yellow color component image of an intended or predetermined color image is formed thereon. Subsequently, the electrostatic latent image is developed by the development unit 4*a* at a development position, thereby being visualized as a yellow toner image on the photosensitive drum 1*a*.

In the present exemplary embodiment, the normal charging polarity of the toner contained in the development unit 4*a* is the negative polarity, and the electrostatic latent image is processed by reversal development using the toner charged to have the same polarity as the charging polarity of the photosensitive drum 1*a* charged by the charging roller 2*a*. However, applicability of the present disclosure is not limited thereto, and the present disclosure can also be applied to an image forming apparatus that processes the electrostatic latent image by positive development using toner charged to have the positive polarity, which is an opposite polarity of the charging polarity of the photosensitive drum 1*a*.

The charging roller 2*a* as the charging member is in contact with the surface of the photosensitive drum 1*a*, and rotates by being driven by the rotation of the photosensitive drum 1*a* with the aid of friction with the surface of the photosensitive drum 1*a*. The charging roller 2*a* is a roller member in which an elastic layer made from a conductive elastic body having a thickness of 1.5 mm and a volume resistivity of approximately $1\times10^6$ Ω·cm is provided on a core metal having a diameter of 5.5 mm. A predetermined voltage is applied from a not-illustrated charging power source to the charging roller 2*a* in response to the image forming operation. The surface potential of the photosensitive drum 1*a* when a voltage of −1100 [V] was applied from the not-illustrated charging power source to the charging roller 2*a* was approximately −500 [V] (measured by Electrostatic Voltmeter Model 344 manufactured by Trek Incorporated).

The exposure unit 3*a* includes a laser driver, a laser diode, a polygonal mirror, and an optical system lens and irradiates the photosensitive drum 1*a* with laser light based on image information input from a host computer (not illustrated) to form the electrostatic latent image on the surface of the photosensitive drum 1*a*. In the present exemplary embodiment, a light amount of the exposure unit 3*a* is adjusted so that the photosensitive drum 1*a* has a surface potential V1 of −100 [V] when being exposed to the maximum light amount from the exposure unit 3*a*.

The development unit 4*a* includes a development roller 41*a* as a development member and the yellow toner, and supplies the toner to the photosensitive drum 1*a* to develop the electrostatic latent image formed on the photosensitive drum 1*a* as the toner image. The development roller 41*a* can come into contact with and be separated from the photosensitive drum 1*a*, and supplies the toner in a state in contact with the photosensitive drum 1*a* with a predetermined contact width. The development roller 41*a* rotates in an opposite direction (clockwise direction) of the direction indicated by the illustrated arrow R1 at a higher circumferential speed than the circumferential speed of the photosensitive drum 1*a*. A development power source (not illustrated) is connected to the development roller 41*a*, and a predetermined voltage (−300 [V] in the present exemplary embodiment) is applied to the development roller 41*a* in response to the image forming operation.

The toner in the present exemplary embodiment is non-magnetic mono-component toner manufactured by the suspension polymerization method. The normal charging polarity of the toner is the negative polarity, and a volume-average particle diameter of the toner is approximately 6.0 μm when the toner is measured by Laser Diffraction Particle Size Analyzer LS-230 manufactured by Beckman Coulter Incorporated. Silicon oxide particles are attached to a surface of the toner by approximately 1.5% to the weight of the toner as an external additive to modify a surface property, and a volume-average particle diameter of the silicon oxide particles is approximately 20 nm. The toner manufactured by the suspension polymerization method is used in the present exemplary embodiment, but the used toner is not limited thereto and may be toner manufactured by another polymerization method such as the pulverization method and the emulsion polymerization method.

An intermediate transfer belt 20 as an intermediate transfer member is an endless and movable belt to which electrical conductivity is provided by adding a conducting agent to a resin material. The intermediate transfer belt 20 is stretched around three axes, namely, tension rollers 11, 12, and 13 and is rotationally driven at substantially the same circumferential speed as each of the photosensitive drums 1*a* to 1*d*. The intermediate transfer belt 20 forms a primary transfer portion N1*a* by coming into contact with the photosensitive drum 1*a*, and the yellow toner image formed on the photosensitive drum 1*a* is primarily transferred from the photosensitive drum 1*a* onto the intermediate transfer belt 20 in the course of passing through the primary transfer portion N1*a*.

Figure 2:
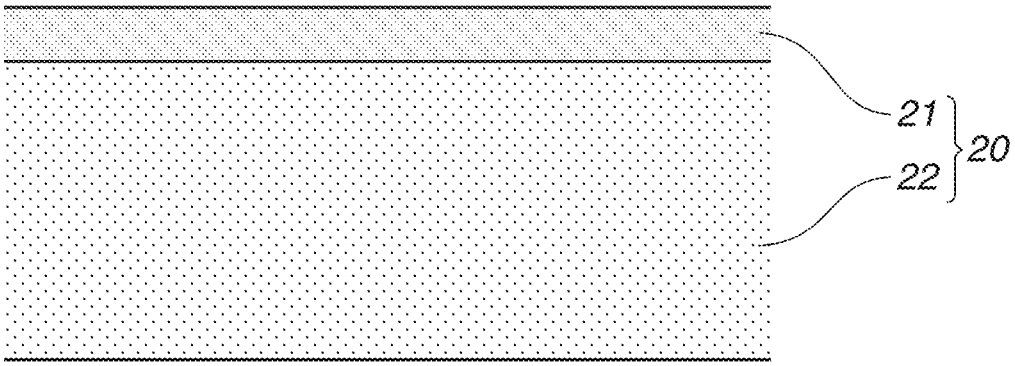
FIG. 2 is a schematic view illustrating a configuration of an intermediate transfer belt according to the first exemplary embodiment.

FIG. 2 is a schematic view illustrating a configuration of the intermediate transfer belt 20. As illustrated in FIG. 2, the intermediate transfer belt 20 includes two layers, namely, a surface layer 21 and a base layer 22, in a thickness direction of the intermediate transfer belt 20 perpendicular to a movement direction of the intermediate transfer belt 20. The surface layer 21 is a layer that is exposed on the outer peripheral surface side of the intermediate transfer belt 20 and provided at a position closer to the photosensitive drums 1*a* to 1*d* than the base layer 22 is in the thickness direction of the intermediate transfer belt 20. A circumferential length, which is the length in the movement direction of the intermediate transfer belt 20, is 700 mm.

The surface layer 21 is formed by applying an acrylic resin coating material having a thickness of approximately 2 μm on the surface of the base layer 22, and has higher smoothness compared to the base layer 22. Desirably, the thickness of the surface layer 21 is set to be within a range of 0.5 to 4.0 μm in light of the condition of the manufacturing and the smoothness. The base layer 22 is a layer made from a material mainly containing polyester and having a thickness of approximately 100 μm. The above-described surface layer 21 is thinner in thickness (film thickness) than the base layer 22 and thus is less influential on a resistance value of the intermediate transfer belt 20, but may be subjected to a resistance adjustment so as to have a desired resistance value by adding a conducting agent such as carbon black to the surface layer 21 as necessary.

The resin material applied to the base layer 22 to form the surface layer 21 is not particularly limited, and examples of usable materials therefor include polyester, polyether, polycarbonate, polyalylate, urethane, silicon, and fluororesin. The material constituting the base layer 22 is not limited to polyester, and another material may be used as long as it is a thermoplastic resin. Examples of usable materials therefor include polyimide, polycarbonate, polyalylate, acrylonitrile-butadiene-styrene copolymer (ABS), polyphenylene sulfide (PPS), polyvinylidene fluoride (PVDF), and a mixed resin of any of them.

A primary transfer roller 14*a* as a transfer member is provided on an inner peripheral surface side of the intermediate transfer belt 20 at a position where it faces the photosensitive drum 1*a* via the intermediate transfer belt 20. A primary transfer power source 16 is connected to the primary transfer roller 14*a*. The primary transfer roller 14*a* is made of a nickel-plated stainless steel (SUS) round rod having a straight shape and the outer diameter of 6 mm. The primary transfer roller 14*a* is in contact with the intermediate transfer belt 20 over a predetermined area in a longitudinal direction thereof intersecting the movement direction of the intermediate transfer belt 20 and rotates by being driven along with the rotation of the intermediate transfer belt 20.

Now, in the present exemplary embodiment, each of the primary transfer rollers 14*a* to 14*d* is disposed in such a manner that each of the primary transfer rollers 14*a* to 14*d* and the intermediate transfer belt 20 are in contact with each other at a position downstream of each of the primary transfer portions N1*a* to N1*d* in the movement direction of the intermediate transfer belt 20. However, without being limited thereto, each of the primary transfer rollers 14*a* to 14*d* may be disposed upstream of each of the primary transfer portions N1*a* to N1*d*. In a case where a roller covered with rubber or sponge or a non-rotatable fixed member containing resin is used as the primary transfer member, the primary transfer member may be disposed immediately below each of the primary transfer portions N1*a* to N1*d*, i.e., at a position where the primary transfer member biases each of the photosensitive drums 1*a* to 1*d* via the intermediate transfer belt 20.

The primary transfer power source 16 applies a voltage of 500 [V] to the primary transfer roller 14*a* based on the image forming operation. As a result, a potential is formed on the conductive intermediate transfer belt 20, and the yellow toner image is primarily transferred from the photosensitive drum 1*a* onto the intermediate transfer belt 20. In the present exemplary embodiment, the image forming apparatus 100 employs the configuration in which the voltage is applied from the primary transfer power source 16 common to the primary transfer rollers 14*a* to 14*d*. However, the configuration is not limited thereto, and the image forming apparatus 100 may include transfer power sources that apply voltages to the respective primary transfer rollers 14*a* to 14*d* separately, or may be configured to cause only some of the primary transfer rollers 14*a* to 14*d* to share a common transfer power source therefor.

Similarly, the magenta toner image as a second color, the cyan toner image as a third color, and the black toner image as a fourth color are formed by the second, third, and fourth image forming units Sb, Sc, and Sd, respectively, and are primarily transferred while being sequentially superimposed onto the intermediate transfer belt 20. As a result, the toner images of the four colors corresponding to the intended or predetermined color image are formed on the intermediate transfer belt 20. Then, the toner images of the four colors borne on the intermediate transfer belt 20 are collectively secondarily transferred onto a surface of a transfer material P such as paper and an overhead transparency (OHT) fed by a feeding unit 60 in the course of passing through a secondary transfer portion N2 where a secondary transfer roller 15 and the intermediate transfer belt 20 come in contact with each other. The transfer material P is contained in a sheet feeding cassette 50, and is fed toward the secondary transfer portion N2 by a rotation of the feeding unit 60.

The secondary transfer roller 15 serving as a secondary transfer member is a member having an outer diameter of 18 mm and is formed by covering a nickel-plated steel rod having an outer diameter of 6 mm with a foamed sponge body adjusted to have a volume resistivity of $10^8$ Ω·cm and a thickness of 6 mm and mainly containing nitrile butadiene rubber (NBR) and epichlorohydrin-based rubber. The rubber hardness of the foamed sponge body is 30° (ASKER Durometer Type C). The secondary transfer roller 15 is in contact with the outer peripheral surface of the intermediate transfer belt 20 and forms the secondary transfer portion N2 where the secondary transfer roller 15 presses a counter roller 13 as a counter member via the intermediate transfer belt 20 with a pressing force of approximately 50 N.

A secondary transfer power source 18 is connected to the secondary transfer roller 15. The secondary transfer power source 18 applies a voltage to the secondary transfer roller 15, thereby allowing the toner images to be secondarily transferred from the intermediate transfer belt 20 onto the transfer material P at the secondary transfer portion N2. The secondary transfer power source 18 can output a voltage in a range of 100 to 4000 [V], and secondarily transfers the toner images from the intermediate transfer belt 20 onto the transfer material P at the secondary transfer portion N2 by applying a voltage of 2500 [V] in the present exemplary embodiment.

Now, the intermediate transfer belt 20 according to the present exemplary embodiment can reduce a micro space generated between the intermediate transfer belt 20 and the surface of the transfer material P due to the above-described highly smooth surface layer 21. As a result, it is possible to suppress disorder in an electric field in the secondary transfer portion N2, thereby improving efficiency of the secondary transfer.

The toner images of the four colors borne on the intermediate transfer belt 20 are transferred onto the transfer material P at the secondary transfer portion N2. Then, the transfer material P is introduced into a fixing unit 30 and is heated and pressed there, by which the four colors of toner are fused and color-mixed, and fixed onto the transfer material P. Toner remaining on the intermediate transfer belt 20 after the secondary transfer is swept and removed by a cleaning unit 5 as a collection unit. The cleaning unit 5 is provided so as to face the counter roller 13 via the intermediate transfer belt 20 on a downstream side of the secondary transfer portion N2 and an upstream side of the primary transfer portion N1*a* in the movement direction of the intermediate transfer belt 20. The cleaning unit 5 includes a cleaning blade 51, which is in contact with the outer peripheral surface of the intermediate transfer belt 20, and a cleaning container 52, which accommodates, for example, the toner removed from the intermediate transfer belt 20 by the cleaning blade 51.

The cleaning blade 51 is a plate-shaped (blade-shaped) member made from an elastic material that has predetermined lengths in a longitudinal direction, which is a direction substantially perpendicular to the movement direction of the intermediate transfer belt 20, and in a lateral direction substantially perpendicular to the longitudinal direction, and has a predetermined thickness. The cleaning blade 51 is in contact with the intermediate transfer belt 20 in such a manner that an end portion of the cleaning blade 51 on one side (free end side) in the lateral direction over the entire longitudinal direction is placed in a counter direction with respect to the movement direction of the intermediate transfer belt 20. In other words, the cleaning blade 51 is in contact with the intermediate transfer belt 20 in such a manner that the end portion thereof on the free end side faces the upstream side in the movement direction of the intermediate transfer belt 20.

The image forming apparatus 100 according to the present exemplary embodiment does not include a contacting member that collects the toner by coming into contact with the photosensitive drum 1*a* by the time the toner remaining on the photosensitive drum 1*a* after passing through the primary transfer portion N1*a* reaches a charging portion where the charging roller 2*a* and the photosensitive drum 1*a* are in contact with each other. More specifically, the image forming apparatus 100 has the so-called cleaner-less structure unequipped with a collection member such as a cleaning blade in contact with the photosensitive drum 1*a* from the primary transfer portion N1*a* to the charging portion in the rotational direction of the photosensitive drum 1*a*. Thus, transfer residual toner remaining on the photosensitive drum 1*a* after the toner image is primarily transferred from the photosensitive drum 1*a* onto the intermediate transfer belt 20 is collected by the development unit 4*a* after passing through the charging portion.

The image forming apparatus 100 according to the present exemplary embodiment forms a full-color print image by the operation.

[Cleaner-Less Structure]

In the description below, the method for collecting the toner remaining on the photosensitive drums 1*a*, 1*b*, 1*c*, and 1*d* in the cleaner-less structure will be described in detail using the image forming unit Sd as an example.

Two types of toner, the transfer residual toner and re-transferred toner may remain on the photosensitive drum 1*a* after the photosensitive drum 1*a* passes through the primary transfer portion N1*d* as it rotates. Now, the transfer residual toner refers to toner remaining on the photosensitive drum 1*d* without being transferred onto the intermediate transfer belt 20 although being developed as the toner image by the development unit 4*d*. The transfer residual toner is often charged to have the same polarity as the normal charging polarity of the toner, and often remains on the photosensitive drum 1*d* in a negatively-charged state in the present exemplary embodiment.

Then, some of the toner borne on the intermediate transfer belt 20 remains on the photosensitive drum 1*a* by accidentally moving from the intermediate transfer belt 20 onto the photosensitive drum 1*d* under influence of an electric discharge or the like when passing through the primary transfer portion N1*d*, and the re-transferred toner refers to such toner. The re-transferred toner is toner that has been transferred onto the intermediate transfer belt 20 at an image forming unit disposed upstream of the image forming unit Sd in the movement direction of the intermediate transfer belt 20, and is accidentally re-transferred from the intermediate transfer belt 20 onto the photosensitive drum 1*d*. The re-transferred toner is easily reversed in polarity under the influence of the electric discharge or the like, and often remains on the photosensitive drum 1*d* in a state of being positively charged in the present exemplary embodiment.

The toner charged oppositely in polarity (positively charged in the present exemplary embodiment) of the normal charging polarity of the toner, among the toner remaining on the photosensitive drum 1*d*, is attached to the charging roller 2*d*, which has been applied with the negative-polarity voltage, after moving along with the rotation of the photosensitive drum 1*d*. On the other hand, the negative-polarity toner reaches the position where the development unit 4*d* and the photosensitive drum 1*d* are in contact with each other after passing through the position where the charging roller 2*d* and the photosensitive drum 1*d* are in contact with each other along with the rotation of the photosensitive drum 1*d*.

At this time, the surface of the photosensitive drum 1*d* has been charged and exposed again by the charging roller 2*d* and an exposure unit 3*d*, respectively, and the electrostatic latent image based on the image information has been formed thereon. Then, an electric field is generated at a portion where the development unit 4*d* and the photosensitive drum 1*d* face each other due to a potential difference between the surface potential of the photosensitive drum 1*d* (−500 V at the unexposed portion and −100 V at the exposed portion) and the voltage applied to a development roller 41*d* (−300 V). In this state, the negative-polarity toner that has reached the portion facing the development unit 4*d* along with the rotation of the photosensitive drum 1*d* is partially collected from the surface of the photosensitive drum 1*d* into the development unit 4*d* with the aid of the above-described electric field.

More specifically, at the unexposed portion, the electric field is formed in a direction of moving the negative-polarity toner from the photosensitive drum 1*d* onto the development roller 41*d*, and thus the negative-polarity toner that remains on the photosensitive drum 1*d* is collected into the development unit 4*d* after moving onto the development roller 41*d*. On the other hand, at the exposed portion, the electric field is formed in a direction of moving the negative-polarity toner from the development roller 41*d* to the photosensitive drum 1*d*, and thus the negative-polarity toner that is borne on the development roller 41*d* moves onto the photosensitive drum 1*d* and develops the electrostatic latent image on the photosensitive drum 1*d*. At this time, the toner remaining on the photosensitive drum 1*d* is also used to develop the electrostatic latent image.

In this manner, the development unit 4*d* according to the present exemplary embodiment is configured to develop the electrostatic latent image formed on the photosensitive drum 1*d* as the toner image using the toner and also to collect the toner remaining on the photosensitive drum 1*d*. By the operation, the toner remaining on the photosensitive drum 1*d* is collected in the cleaner-less structure. The collection of the remaining toner in the image forming unit Sd has been described in the above description, but similar operations are also performed in the image forming units Sa to Sc.

[Condensation Removal Control]

Figure 3:
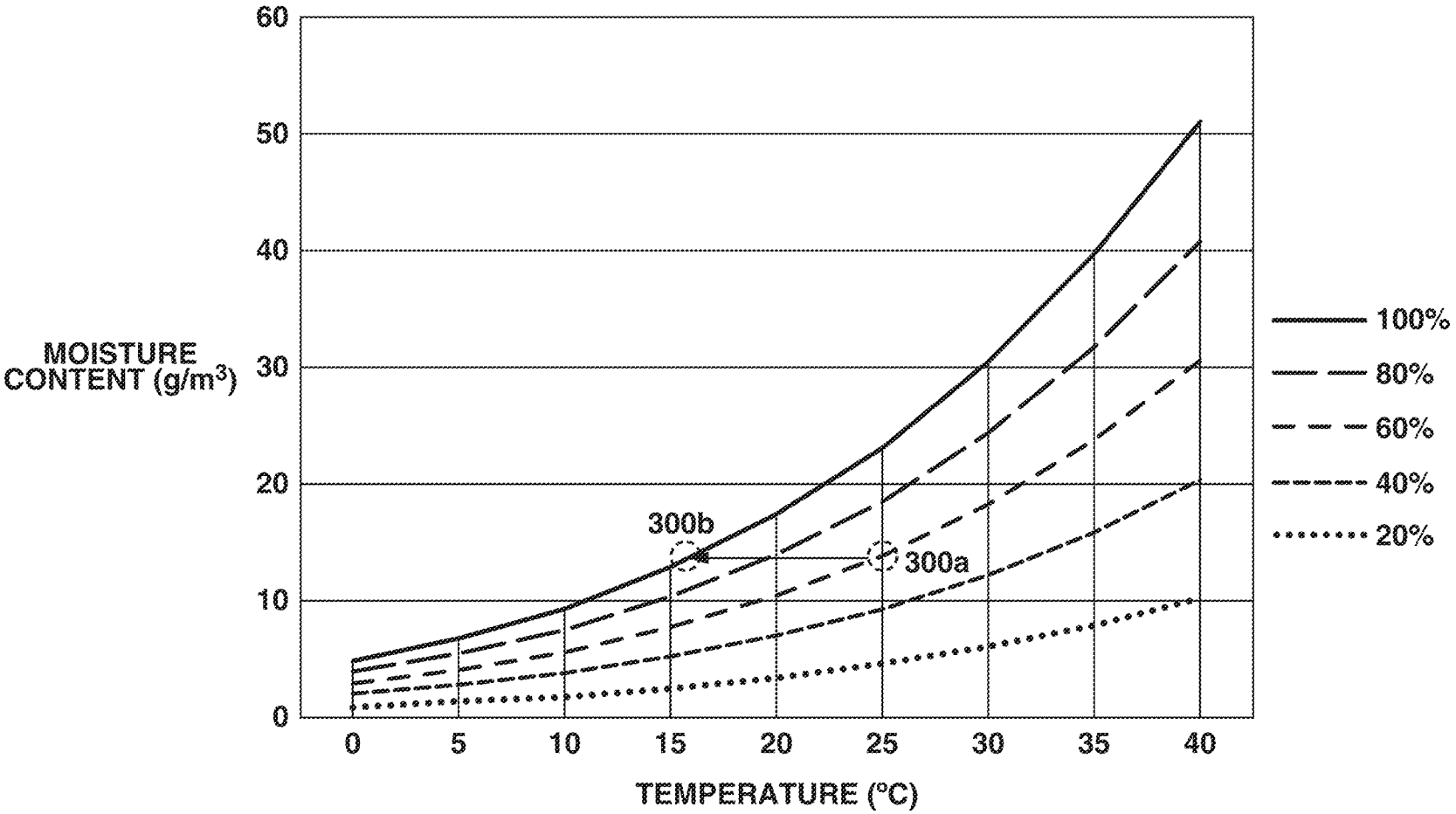
FIG. 3 is a graph illustrating a condensation occurrence condition according to the first exemplary embodiment.

Next, control of removing moisture attached to the surface of the photosensitive drum when condensation has occurred, which is a characterizing feature of the present exemplary embodiment, will be described. FIG. 3 is a graph illustrating a condition under which condensation occurs in the image forming apparatus 100, and is a graph indicating a moisture amount in the air that is calculated based on a humidity and a temperature of an environment outside the image forming apparatus 100.

As illustrated in FIG. 3, it is understood that, in an office environment 300*a* with a temperature of 25° C. and a humidity of 60%, the humidity reaches 100% and condensation occurs if the temperature drops to 16° C. and the office environment shifts to an office environment 300*b*. In other words, the condition under which condensation occurs in the image forming apparatus 100 in the office environment 300*a* with the temperature of 25° C. and the humidity of 60% is that the image forming apparatus 100 has the temperature of 16° C. or lower inside the apparatus. This means that 16° C. is the temperature at which the condensation starts to occur in the office environment 300*b* (hereinafter referred to as a condensation temperature).

In this manner, a phenomenon that the temperature difference is generated between the outside and the inside of the image forming apparatus 100 can occur when the temperature of the environment outside the apparatus rapidly increases due to the operation of an air conditioner or the like, while the image forming apparatus 100 is kept with the inside thereof staying cold.

Figure 4:
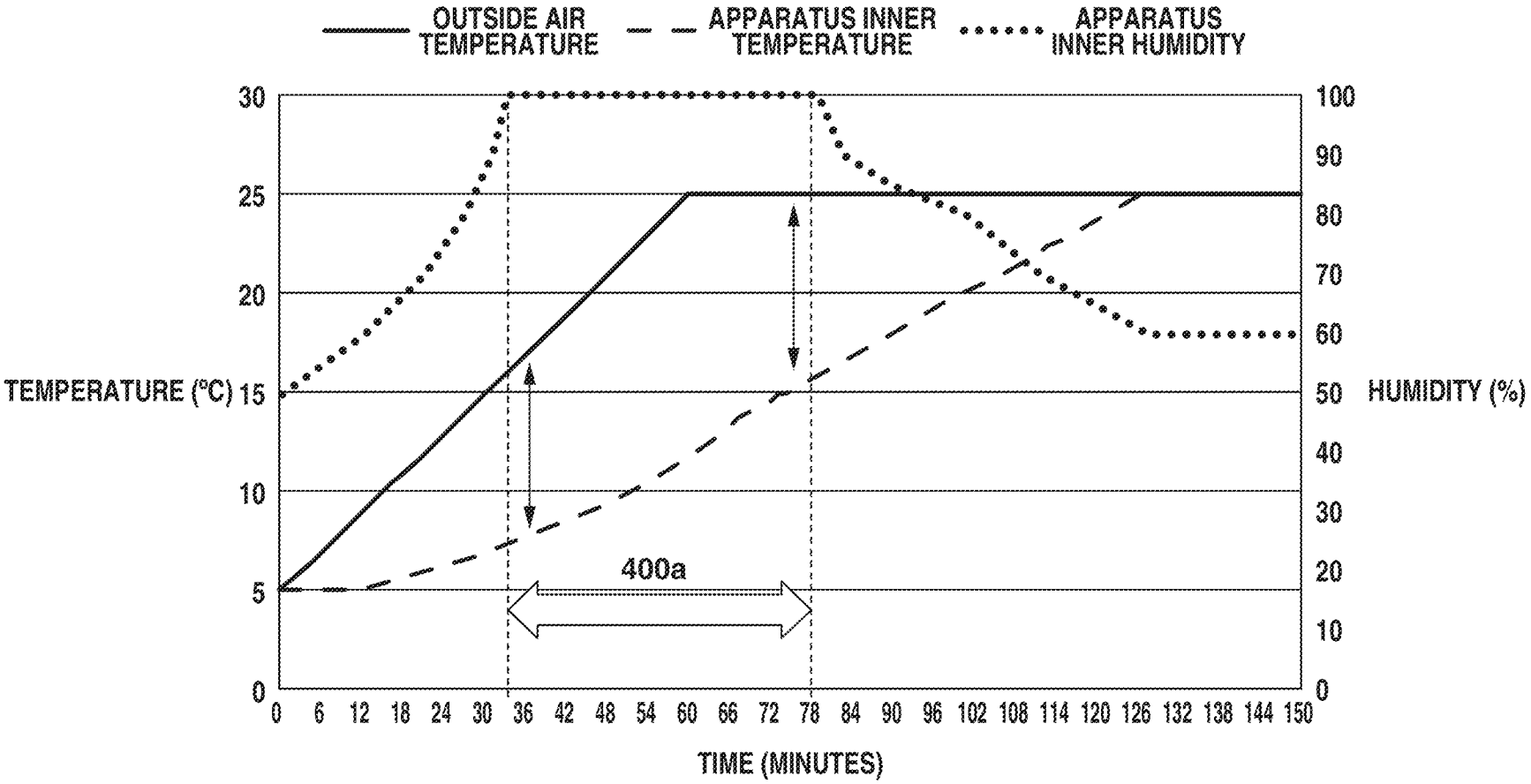
FIG. 4 is a graph illustrating the relationship between an outside air temperature and an apparatus inner temperature of the image forming apparatus according to the first exemplary embodiment.

FIG. 4 is a graph illustrating the relationship among the temperature of the environment outside the image forming apparatus 100 (hereinafter referred to as an outside air temperature), the temperature inside the image forming apparatus 100 (hereinafter referred to as an apparatus inner temperature) when the image forming operation is not performed before the measurement, and the apparatus inner temperature measured after the image forming operation is performed. If the air conditioner or the like is started up to increase the outside air temperature, the outside air temperature increases from 5° C. to 25° C. in approximately 60 minutes while the apparatus inner temperature gradually increases in approximately 120 minutes as illustrated in FIG. 4.

In such a case, the graph includes a section 400*a* in which a temperature difference of approximately 9° C. is generated between the outside air temperature and the apparatus inner temperature as illustrated in FIG. 4. If the image forming operation is started in the section 400*a* and the air outside the image forming apparatus 100 flows into the image forming apparatus 100, the warm air is cooled inside the apparatus. As a result, condensation occurs particularly on a member having a large heat capacity such as the photosensitive drums 1*a* to 1*d* because the temperature does not increase immediately thereon, and moisture is attached to the surfaces of the photosensitive drums 1*a* to 1*d*. Then, once the moisture is attached to the member due to the condensation, even when the temperature difference between the temperature of the member and the outside air temperature falls to or below the temperature difference causing the condensation, the moisture on the surface of the member remains thereon for a while without disappearing immediately. Thus, a certain length of time is required in the case of just waiting for the condensation to be removed without performing any special control.

With the aim of addressing such an issue, in the present exemplary embodiment, the image forming apparatus 100 performs a condensation removal control by the controller 101, thereby being able to remove the condensation to reduce the moisture attached to the photosensitive drums 1*a* to 1*d* more quickly than with the conventional technique. In the following description, the details thereof will be described.

First, processing for determining the occurrence of the condensation performed by the controller 101 in the condensation removal control according to the present exemplary embodiment will be described. The controller 101 regularly monitors values of an environmental sensor 102 (first detection unit) and an environmental sensor 103 (second detection unit) provided to the image forming apparatus 100. More specifically, the controller 101 acquires the outside air temperature each or every minute in a waiting state not performing the image forming operation to monitor an increase in the temperature in a short time.

Now, the environmental sensor 102 and the environmental sensor 103 may be any detection units capable of detecting at least one of the temperature and the humidity. In the present exemplary embodiment, the environmental sensor 102 and the environmental sensor 103 can detect both the temperature and the humidity. The environmental sensor 102 and the environmental sensor 103 may be mounted anywhere in the image forming apparatus 100 as long as the environmental sensors 102 and 103 can acquire the apparatus inner temperature and the outside air temperature.

As illustrated in FIG. 3, the condensation more likely forms as the temperature difference is larger between the outside air temperature and the apparatus inner temperature and as the environment has a lower temperature. Further, as illustrated in FIG. 4, the condensation forms due to the difference between the outside air temperature and the apparatus inner temperature. Thus, it is desirable to compare the difference between the outside air temperature and the apparatus inner temperature for the condensation occurrence/non-occurrence determination. In the condensation removal control according to the present exemplary embodiment, the condition for determining that the condensation has occurred by the controller 101 is set to the presence of a difference (temperature difference) of 9° C. or more between the apparatus inner temperature and the outside air temperature detected by the environmental sensor 102 and the environmental sensor 103.

Figure 5:
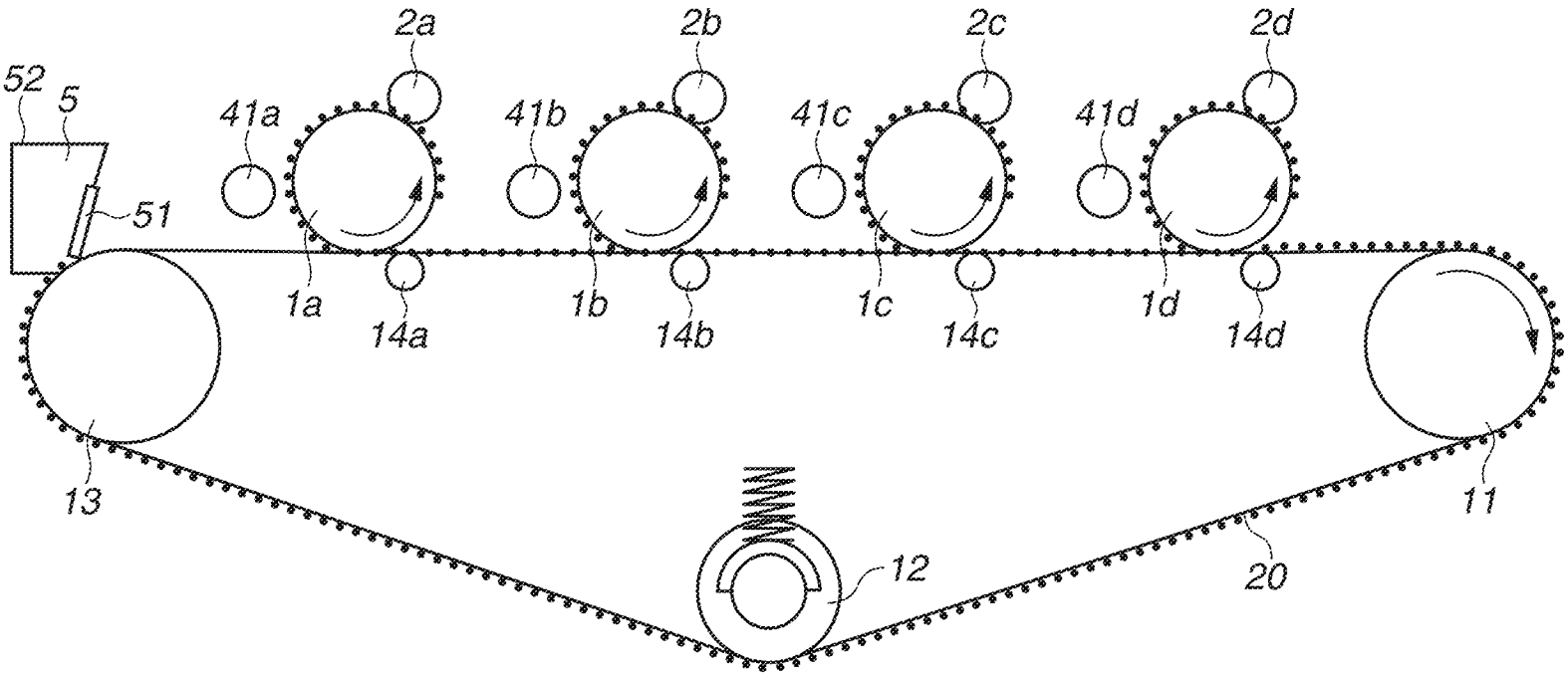
FIG. 5 is a schematic view illustrating condensation removal control according to the first exemplary embodiment.

Next, an operation of performing the condensation removal control according to the present exemplary embodiment will be described with reference to FIG. 5. FIG. 5 is a schematic cross-sectional view of the image forming apparatus 100 for illustrating the operation of performing the condensation removal control according to the present exemplary embodiment, and indicates a process of removing the moisture attached to the surfaces of the photosensitive drums 1*a* to 1*d*. A dotted line in FIG. 5 indicates a movement path of the moisture attached to the surfaces of the photosensitive drums 1*a* to 1*d*.

When it is determined that the condensation has occurred based on the above-described condensation occurrence/non-occurrence determination based on the difference between the outside air temperature and the apparatus inner temperature, first, the controller 101 separates the development rollers 41*a* to 41*d* from the photosensitive drums 1*a* to 1*d*, respectively. Then, the controller 101 drives the photosensitive drums 1*a* to 1*d* and the intermediate transfer belt 20, thereby rotationally driving the photosensitive drums 1*a* to 1*d* and the intermediate transfer belt 20 for a predetermined time without carrying out the image formation. At this time, the controller 101 sets the voltages to apply to the charging rollers 2*a* to 2*d* and the voltages to apply to the primary transfer rollers 14*a* to 14*d* to OFF states, and performs the rotational operation with a predetermined speed difference between rotational speeds of the photosensitive drums 1*a* to 1*d* and a rotational speed of the intermediate transfer belt 20. Now, the rotational speeds of the photosensitive drums 1*a* to 1*d* refer to the movement speeds of the surfaces of the photosensitive drums 1*a* to 1*d* (first surface speed), and the rotational speed of the intermediate transfer belt 20 refers to the movement speed of the surface of the intermediate transfer belt 20 (second surface speed).

As a result, as illustrated in FIG. 5, the moisture attached to the surfaces of the photosensitive drums 1*a* to 1*d* due to the occurrence of the condensation is moved from the photosensitive drums 1*a* to 1*d* to the intermediate transfer belt 20 due to the speed difference in surface speed between the photosensitive drums 1*a* to 1*d* and the intermediate transfer belt 20. Then, the moisture moved to the intermediate transfer belt 20 reaches the cleaning unit 5 due to the rotational movement of the intermediate transfer belt 20, and is scraped by the cleaning blade 51, which is in contact with the intermediate transfer belt 20, and is collected into the cleaning container 52.

The speed difference between the surface speeds of the photosensitive drums 1*a* to 1*d* and the surface speed of the intermediate transfer belt 20 at the time of performing the condensation removal control in the configuration according to the present exemplary embodiment is set to be equal to the speed difference at the time of performing the image forming operation. More specifically, the speed difference is set in such a manner that a ratio of the second surface speed of the intermediate transfer belt 20 to the first surface speed of the photosensitive drums 1*a* to 1*d* becomes 105%. In the description below, the ratio of the surface speed of the intermediate transfer belt 20 (105%) to the surface speeds of the photosensitive drums 1*a* to 1*d* (100%) will be referred to as a circumferential speed difference. Further, in the present exemplary embodiment, a duration of the execution of the condensation removal control (the above-described predetermined time) is set to 60 seconds. In other words, in a case where it is determined that the condensation has occurred, the controller 101 rotationally drives the photosensitive drums 1*a* to 1*d* and the intermediate transfer belt 20 for the predetermined time of approximately 60 seconds at the circumferential speed difference of 105% without carrying out the image formation.

In the configuration according to the present exemplary embodiment, the surface of the intermediate transfer belt 20 that has passed through the portion where the cleaning blade 51 and the intermediate transfer belt 20 are in contact with each other is brought into a state where the moisture is removed by the cleaning blade 51. In other words, performing the condensation removal control according to the present exemplary embodiment causes the outer peripheral surface of the intermediate transfer belt 20, to which no moisture is attached, to contact the surfaces of the photosensitive drums 1*a* to 1*d* after the intermediate transfer belt 20 passes through the cleaning unit 5 as illustrated in FIG. 5. Further, since the intermediate transfer belt 20 has a thin film thickness and a small heat capacity compared to the photosensitive drums 1*a* to 1*d*, temperatures of members of the intermediate transfer belt 20 easily get close to the outside temperature quickly when the air outside the image forming apparatus 100 flows into the apparatus. Thus, the condensation is unlikely to form on the surface of the intermediate transfer belt 20.

<Functions and Advantageous Effects>

To describe advantageous effects of the configuration according to the present exemplary embodiment, a time required for the condensation removal control was evaluated with respect to each of configurations in which the circumferential speed difference between the surface speed of the intermediate transfer belt 20 and the surface speeds of the photosensitive drums 1*a* to 1*d* was changed.

In the description below, the evaluation method will be described. First, the temperature of the environment in which the image forming apparatus 100 was set up was increased from 5° C. to 25° C., spending 60 minutes, and then, the image formation was started. In other words, the condensation was caused by performing the image forming operation in the section 400*a* in which the temperature difference is approximately 9° C. between the outside air temperature and the apparatus inner temperature illustrated in FIG. 4 and by introducing warm outside air into the image forming apparatus 100. Then, in the situation where the condensation had occurred, the above-described condensation removal control was performed under a condition of the circumferential speed difference in a state where the image forming operation is not performed (in a non-image-forming period), and a time taken until the moisture was removed was measured.

In the condensation removal control according to the present exemplary embodiment, the circumferential speed difference is set to 105% so that the circumferential speed difference between the photosensitive drums 1*a* to 1*d* and the intermediate transfer belt 20 becomes equal to the circumferential speed difference therebetween when the image forming operation is performed. The circumferential speed difference of 105% here refers to the ratio of the surface speed of the intermediate transfer belt 20 to the surface speeds of the photosensitive drums 1*a* to 1*d*.

In a modification example of the present exemplary embodiment, the circumferential speed difference when the condensation removal control is performed is set to 120%, which is a higher value than the circumferential speed difference when the image forming operation is performed. In other words, in the modification example, the intermediate transfer belt 20 is rotationally driven in such a manner that the intermediate transfer belt 20 rotates at a surface speed of 120% to the surface speeds of the photosensitive drums 1*a* to 1*d*. When the image formation is carried out, excessively increasing the circumferential speed difference leads to generation of a blur in the toner image when the toner images borne on the photosensitive drums 1*a* to 1*d* are transferred onto the intermediate transfer belt 20. Thus, in the modification example, the circumferential speed difference when the image forming operation is performed is set to 105%, which is the same value as the circumferential speed difference when the image forming operation is performed in the present exemplary embodiment. Further, except that the circumferential speed difference when the condensation removal control is performed is different from that in the present exemplary embodiment, the configuration of the modification example is similar to the present exemplary embodiment.

On the other hand, in a comparative example of the present exemplary embodiment, the circumferential speed difference between the photosensitive drums and the intermediate transfer belt was constantly set to 100%, and a time taken until the moisture was removed from the surface of each of the photosensitive drums by rotationally driving each of the members without carrying out the image forming operation was measured. In other words, in the comparative example, each of the members is rotationally driven in such a manner that the surface speed of each of the photosensitive drums and the surface speed of the intermediate transfer belt are equal to each other regardless of whether each member is rotationally driven while the image formation is carried out or is rotationally driven while the image formation is not carried out. Further, except that the circumferential speed difference when the operation of rotating each of the members is performed to remove the condensation and the circumferential speed difference when the image forming operation is carried out are different from that of the present exemplary embodiment, the configuration of the comparative example is similar to that according to the present exemplary embodiment.

Next, a result of the evaluation will be descried. A table 1 is a table indicating the relationship between the setting value of the circumferential speed difference and the time taken to remove the condensation with respect to each of the present exemplary embodiment, the modification example, and the comparative example.

TABLE 1

| | Circumferential Speed Difference | Time Taken to Remove Condensation |
|---|---|---|
| First Exemplary Embodiment | 105% | 60 seconds |
| Modification Example | 120% | 45 seconds |
| Comparative Example | 100% | 300 seconds |

As described above, in the configuration according to the present exemplary embodiment, the moisture attached to the surfaces of the photosensitive drums 1*a* to 1*d* is moved from the photosensitive drums 1*a* to 1*d* to the intermediate transfer belt 20 due to the circumferential speed difference between the photosensitive drums 1*a* to 1*d* and the intermediate transfer belt 20. Then, the moisture moved to the intermediate transfer belt 20 is scraped by the cleaning blade 51 in contact with the intermediate transfer belt 20 and is collected into the cleaning container 52. In this manner, the configuration according to the present exemplary embodiment drives the intermediate transfer belt 20 at the circumferential speed difference of 105% to the photosensitive drums 1*a* to 1*d*, thereby allowing the moisture attached to the photosensitive drums 1*a* to 1*d* to be mechanically scraped with the aid of the circumferential speed difference of the intermediate transfer belt 20. As indicated in the table 1, in the condensation removal control according to the present exemplary embodiment, the image forming apparatus 100 was able to collect the moisture attached to the photosensitive drums 1*a* to 1*d* and remove the condensation in 60 seconds.

The condensation removal control according to the modification example drives the intermediate transfer belt 20 at the circumferential speed difference of 120% to the surface speeds of the photosensitive drums 1*a* to 1*d*. Thus, as indicated in the table 1, the time required to remove the condensation was shortened, compared to that in the configuration according to the present exemplary embodiment, to 45 seconds. Now, the modification example sets the circumferential speed difference when the image formation is carried out to 105% as a countermeasure against a blur in the toner image at the time of the transfer. Thus, it is necessary to provide an additional mechanism for making the circumferential speed difference between the photosensitive drums 1*a* to 1*d* and the intermediate transfer belt 20 variable.

More specifically, in the modification example, the circumferential speed difference when the image formation is carried out and the circumferential speed difference at the time of the condensation removal control are switched by separately providing the driving source (not illustrated) for rotationally driving the photosensitive drums 1*a* to 1*d* and the driving source (not illustrated) for rotationally driving the intermediate transfer belt 20. On the other hand, in the configuration according to the present exemplary embodiment, the circumferential speed difference when the image formation is carried out and the circumferential speed difference at the time of the condensation removal control are set to the same value, thereby eliminating the necessity of additionally providing the unit for switching the circumferential speed difference as in the modification example. In other words, in the configuration according to the present exemplary embodiment, a simple configuration for adjusting a ratio of gears for the driving may be employed so that the photosensitive drums 1*a* to 1*d* and the intermediate transfer belt 20 can be rotationally driven using the same driving source (not illustrated).

In the comparative example, to remove the condensation on each of the photosensitive drums, the photosensitive drums and the intermediate transfer belt are rotationally driven at the same speed (movement speed of the surface) without carrying out the image formation. As a result, in the comparative example, the moisture attached to each of the photosensitive drums cannot be mechanically scraped unlike the present exemplary embodiment and the modification example, thereby resulting in a significant increase in the time taken to remove the condensation and spending 300 seconds therefor, as indicated in the table 1.

In the above-described manner, in the present exemplary embodiment, the image forming apparatus 100 performs, by the control unit, the condensation removal control of bringing the development member into the state separated from the image bearing member and rotationally driving the image bearing member and the belt so as to generate the speed difference between the surface speed of the image bearing member and the surface speed of the belt when the condensation has occurred in the cleaner-less structure. Due to this control, the image forming apparatus 100 can remove the moisture attached to the surface of the image bearing member due to the condensation with a simple configuration. Further, the image forming apparatus 100 can prevent or cut down the increase in the time taken to remove the condensation by rotationally driving the image bearing member and the belt with the speed difference therebetween. As a result, the present exemplary embodiment can contribute to preventing or reducing the occurrence of an image defect due to the condensation in the image forming apparatus having the cleaner-less structure.

Now, it is desirable to set the circumferential speed difference, which is the ratio of the surface speed of the intermediate transfer belt 20 to the surface speeds of the photosensitive drums 1*a* to 1*d*, to 100.5% or higher and, more desirably, to 101% or higher in light of efficiently removing the condensation. Further, it is desirable to set the circumferential speed difference to 105% or lower and, more desirably, to 104% or lower in light of preventing or reducing an image blur when performing the image forming operation.

The condition for determining that the condensation has occurred by the controller 101 is set to the detection of the temperature difference equal to or larger than the predetermined value between the outside air temperature and the apparatus inner temperature in the present exemplary embodiment, but is not limited thereto. For example, the condensation may be determined as having occurred based on a humidity difference between the apparatus inner humidity and the outside air humidity detected by the environmental sensor 102 and the environmental sensor 103, or may be determined as having occurred based on only the result of the detection of the outside air temperature by the environmental sensor 103. Alternatively, the condensation may be determined as having occurred if the humidity detected by the environmental sensor 102 capable of detecting the temperature and the humidity inside the image forming apparatus 100 exceeds a predetermined threshold value (for example, 95%). Then, in the case where the condensation is determined as having occurred if the humidity inside the image forming apparatus 100 exceeds the predetermined threshold value, a detection unit capable of detecting only the humidity inside the apparatus may be used as the detection unit provided to the image forming apparatus 100.

In the case where the occurrence of the condensation is determined only based on the result of the detection of the outside air temperature, acquiring adaptability of the apparatus inner temperature to the outside air temperature as data in advance allows the image forming apparatus 100 to set the condition for determining the occurrence of the condensation while predicting a change in the apparatus inner temperature with respect to the outside air temperature. More specifically, for example, the condition for determining the condensation is set to detection of a change in the outside air temperature from a state of 15° C. or less by 10° C. or more within 30 minutes. With a gentler change in the temperature than that, the condensation will be instantly dried even if the condensation occurs. Thus, the condensation is considered less likely to be visible as an image defect in the present exemplary embodiment. The condition for determining the occurrence of the condensation can also be set with the data acquired in advance in this manner, and such a method allows the occurrence of the condensation to be determined using a single environmental sensor, thereby also leading to simplification of the configuration.

As another method, whether the condensation has occurred in the image forming apparatus 100 can also be determined by detecting a value of a direct current flowing from the charging roller toward the photosensitive drum and making the determination based on the detected value of the direct current. The method utilizes such a principle that, when a discharge product containing moisture exists between the charging roller and the photosensitive drum, an injection charging state is established, and thus the discharge start voltage reduces. In other words, it becomes possible to determine the injection charging state to thus determine that moisture is attached to the surface of the photosensitive drum by detecting the value of the direct current that flows upon application of a predetermined direct-current voltage near the discharge start voltage.

The above-descried method using the detection of the current can also determine whether the condensation has occurred by using a result of detection of a current flowing between the photosensitive drum and the primary transfer roller and a result of detection of a current flowing between the intermediate transfer belt and the secondary transfer roller.

As yet another method, the condensation state on the photosensitive drum or the intermediate transfer belt may be detected by a toner detection sensor used to adjust an image density. The method is a method that detects a change in the surface property of the member that occurs when moisture is attached to the photosensitive drum or the intermediate transfer belt using this toner detection sensor.

The first exemplary embodiment has been described regarding the configuration for performing the condensation removal control using the intermediate transfer belt 20 including the surface layer 21 and the base layer 22. Now, a second exemplary embodiment will be described regarding a configuration for performing the condensation removal control using an intermediate transfer belt 220 on which grooves 20*a* arranged at an angle θ with respect to the movement direction of the intermediate transfer belt 220 are formed on the surface of the intermediate transfer belt 220 on the outer peripheral surface side. The configuration of the second exemplary embodiment is substantially the same as the configuration of the first exemplary embodiment except for the use of the intermediate transfer belt 220 including the grooves 20*a* provided on the surface of the intermediate transfer belt 220. Thus, in the description below, the second exemplary embodiment will be described by assigning the same reference numerals to similar configurations and control to the first exemplary embodiment and omitting the descriptions thereof.

Figure 6:
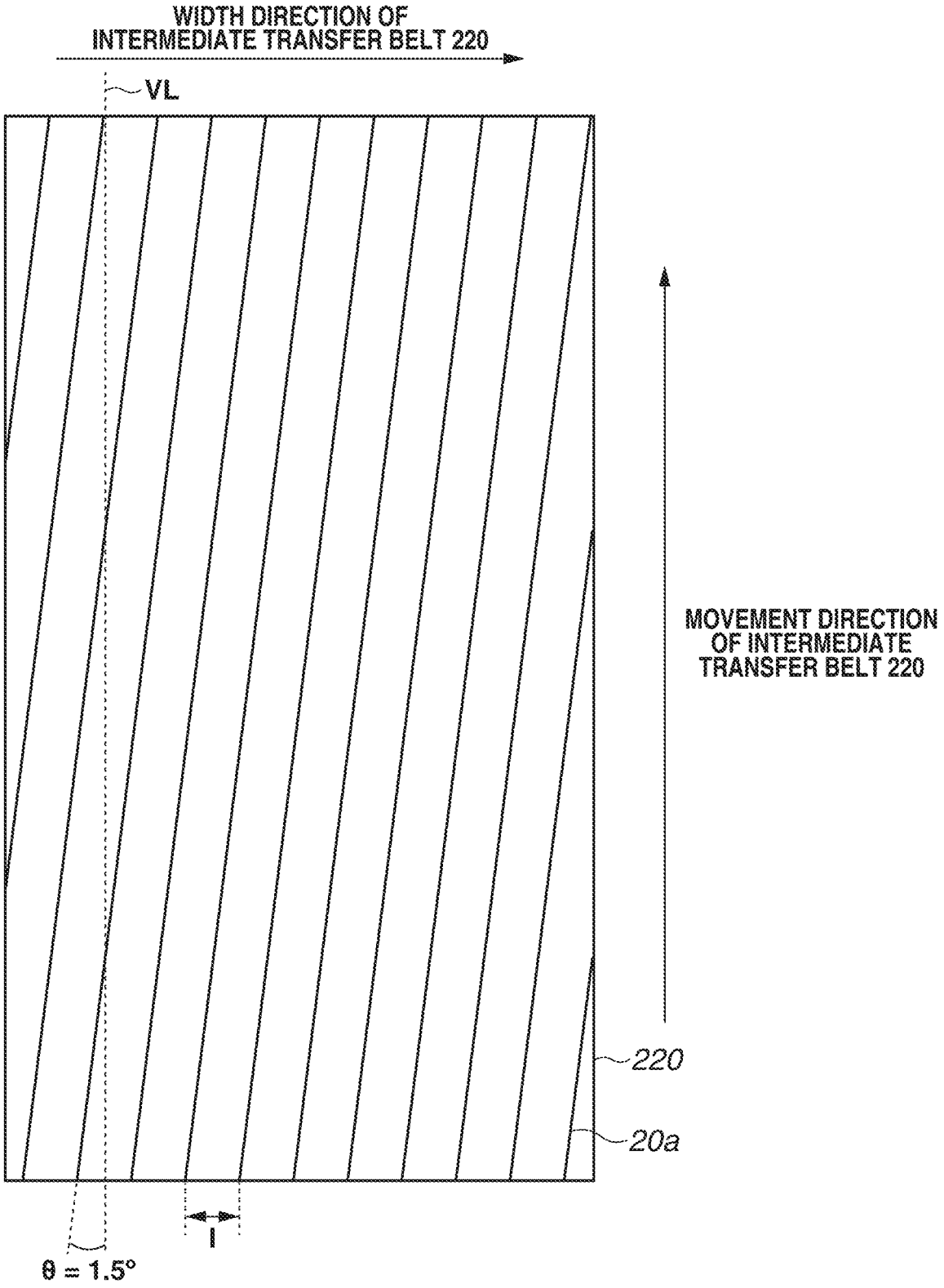
FIG. 6 is a schematic view illustrating a configuration of an intermediate transfer belt according to a second exemplary embodiment.

FIG. 6 is a schematic view illustrating the configuration of the intermediate transfer belt 220 according to the present exemplary embodiment. As illustrated in FIG. 6, the intermediate transfer belt 220 includes the plurality of grooves 20*a* provided on the surface (surface layer) of the intermediate transfer belt 220. The grooves 20*a* extend along the movement direction of the intermediate transfer belt 220 and are arranged at the angle θ with respect to a virtual line VL drawn along the movement direction of the intermediate transfer belt 220. Here, the angle θ is set to θ=1.5°. The grooves 20*a* are formed at an interval I of 18 mm in the width direction intersecting the movement direction of the intermediate transfer belt 220. In the present exemplary embodiment, the interval I between the grooves 20*a* adjacent to each other is set so as to satisfy the following inequality (1) using a circumference length L of the intermediate transfer belt 220 and the angle θ.

$$I \leq L \times \tan\theta \quad (1)$$

Figure 7:
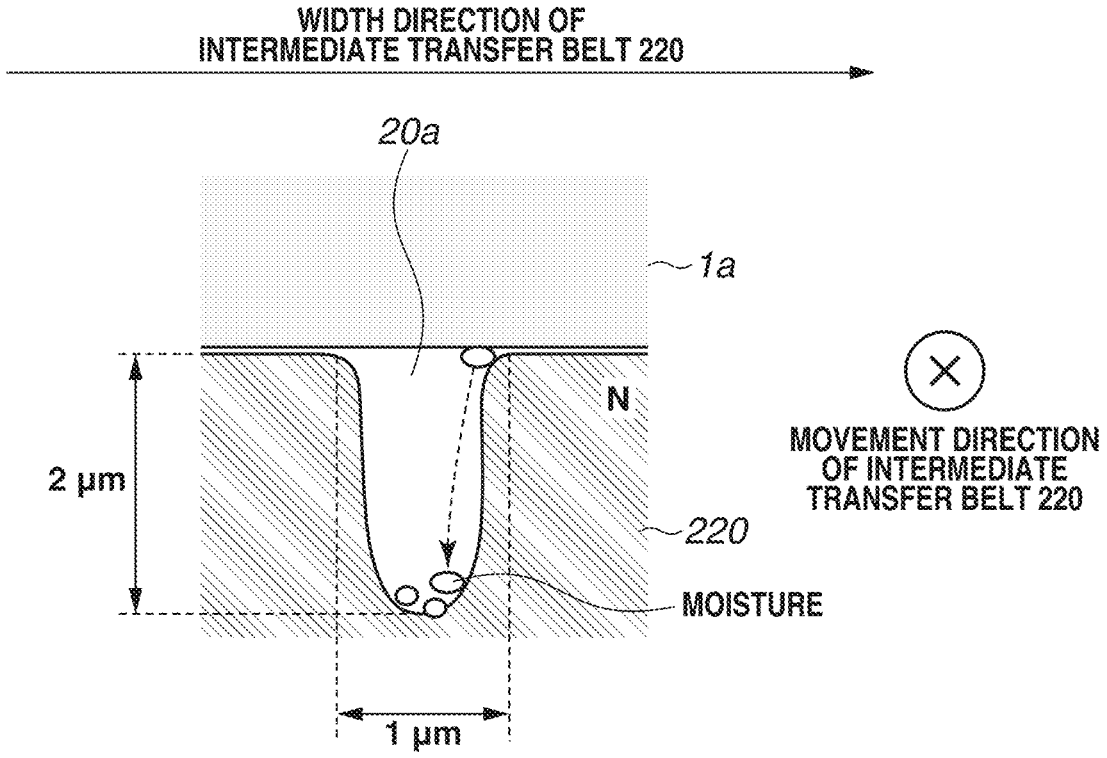
FIG. 7 is a schematic view illustrating removal of condensation according to a second exemplary embodiment.

FIG. 7 is an enlarged cross-sectional view schematically illustrating the portion where the photosensitive drum 1*a* and the intermediate transfer belt 220 are in contact with each other at the primary transfer portion N1*a* when it is viewed from the movement direction of the intermediate transfer belt 220. As illustrated in FIG. 7, in the present exemplary embodiment, the grooves 20*a* each having a width of 1 μm and a depth of 2 μm are formed on the surface of the intermediate transfer belt 220. However, the width and the depth of each of the grooves 20*a* are not limited to the above-described values to acquire the advantageous effects of the present exemplary embodiment, but are desirably set to an average particle diameter of the toner or smaller in light of primary transferability of the toner.

Next, the functions of the present exemplary embodiment will be described. An evaluation similar to that of the first exemplary embodiment was made with respect to the functions of the present exemplary embodiment.

Similarly to the configuration according to the first exemplary embodiment, in the configuration according to the present exemplary embodiment, the moisture attached to the surfaces of the photosensitive drums 1*a* to 1*d* is moved from the photosensitive drums 1*a* to 1*d* to the intermediate transfer belt 220 due to the circumferential speed difference between the photosensitive drums 1*a* to 1*d* and the intermediate transfer belt 220. Then, the moisture moved to the intermediate transfer belt 220 is scraped by the cleaning blade 51 in contact with the intermediate transfer belt 220 and is collected into the cleaning container 52.

At this time, more specifically, the moisture attached to positions at which the photosensitive drums 1*a* to 1*d* and the intermediate transfer belt 220 come in contact with each other, and moisture attached to shallow portions of the grooves 20*a* on the photosensitive drum 1*a* to 1*d* sides are collected by the cleaning blade 51 as with the first exemplary embodiment. On the other hand, moisture attached to portions that do not come in contact with the cleaning blade 51, i.e., deep portions, of the grooves 20*a* in the thickness direction of the intermediate transfer belt 220 is not collected by the cleaning blade 51 but is removed along with the rotation of the intermediate transfer belt 220.

The intermediate transfer belt 220 according to the present exemplary embodiment includes the recessed-shaped grooves 20*a* on the surface thereof, and the moisture attached to the photosensitive drums 1*a* to 1*d* can be further effectively removed due to this configuration. More specifically, as illustrated in FIG. 7, the intermediate transfer belt 220 is configured to easily remove the moisture on the photosensitive drums 1*a* to 1*d* by scraping the moisture attached to the photosensitive drums 1*a* to 1*d* with the edge portions of the grooves 20*a* formed on the intermediate transfer belt 220.

As illustrated in FIG. 6, the interval I between the grooves 20*a* in the width direction of the intermediate transfer belt 220 perpendicular to the movement direction of the intermediate transfer belt 220 is set to the value satisfying the inequality 1. The setting allows the grooves 20*a* to pass any position on the surface of the photosensitive drums 1*a* to 1*d* in the width direction of the intermediate transfer belt 220, i.e., the longitudinal directions of the photosensitive drums 1*a* to 1*d*, as the intermediate transfer belt 220 is circling over and over. As a result, the configuration according to the present exemplary embodiment allows the moisture attached to the surfaces of the photosensitive drums 1*a* to 1*d* to be further effectively removed by the intermediate transfer belt 220 provided with the grooves 20*a*.

In the above-described manner, in the present exemplary embodiment, the condensation can be further effectively removed when the condensation removal control is performed due to the intermediate transfer belt 220 provided with the grooves 20*a* as well as advantageous effects similar to the first exemplary embodiment can be obtained.

Figure 8:
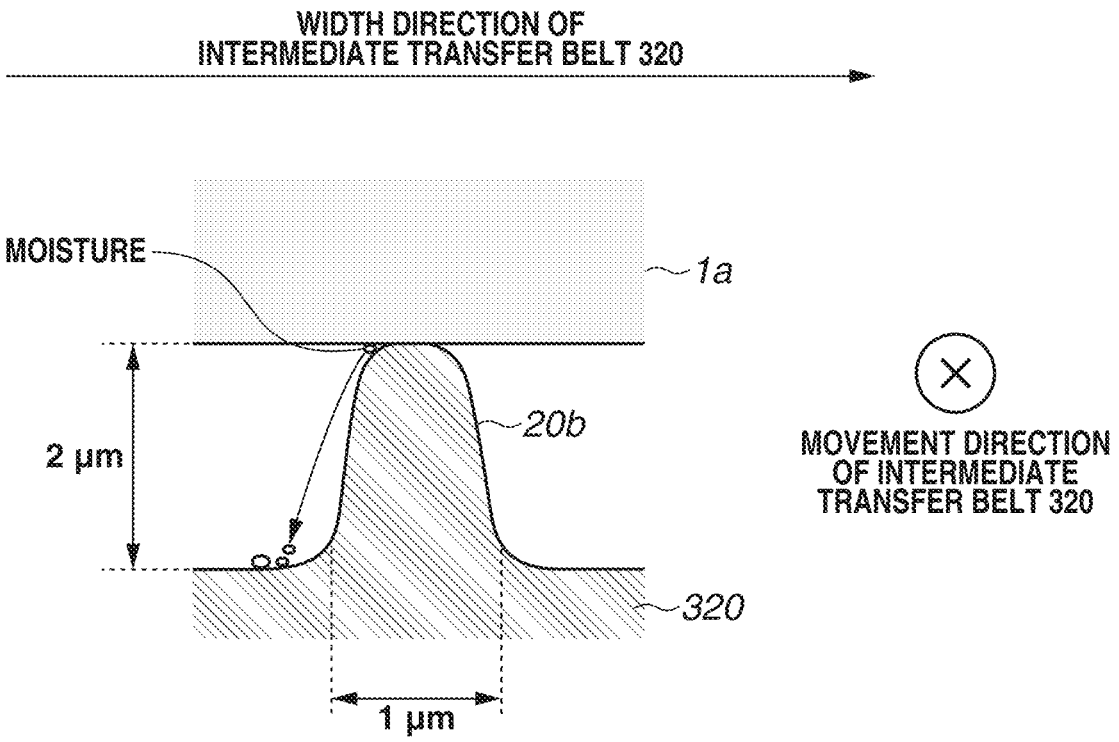
FIG. 8 is a schematic view illustrating a configuration of an intermediate transfer belt according to a modification example of the second exemplary embodiment.

The present exemplary embodiment has been described regarding the configuration including the grooves 20*a* on the surface of the intermediate transfer belt 220, but is not limited thereto and may use, for example, an intermediate transfer belt 320 having a configuration according to a modification example illustrated in FIG. 8. FIG. 8 is a schematic view illustrating a protrusion portion 20*b* formed on a surface of the intermediate transfer belt 320 as the modification example of the present exemplary embodiment, and is a schematic view in which the endless intermediate transfer belt 320 is virtually expanded. Advantageous effects similar to that of the present exemplary embodiment can be acquired by the configuration including a plurality of protrusion portions 20*b* arranged at the angle θ with respect to the movement direction of the intermediate transfer belt 320 on the surface of the intermediate transfer belt 320 as illustrated in FIG. 8.

In the modification example of the present exemplary embodiment, the angle θ is set to =1.5°. The protrusion portions 20*b* are formed at the intervals I of 18 mm in the width direction of the intermediate transfer belt 320, and the interval I is set so as to satisfy the inequality 1 as with the present exemplary embodiment. The width and the height of the protrusion portion 20*b* are desirably set to the average particle diameter or smaller of the toner in light of the primary transferability of the toner, and are set to 1 μm and 2 μm, respectively, in the present modification example.

Figure 9:
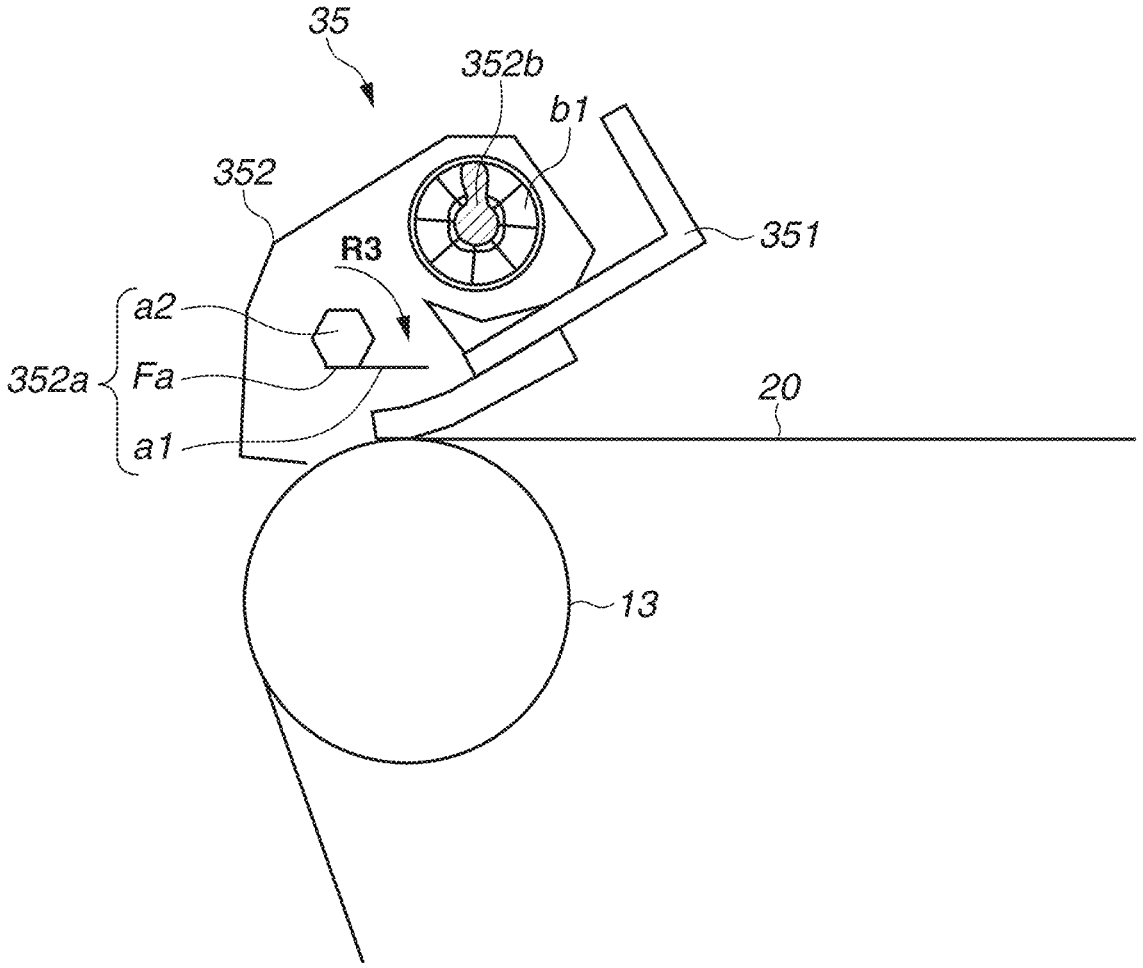
FIG. 9 is a schematic cross-sectional view illustrating a configuration of a cleaning unit according to a third exemplary embodiment.

A third exemplary embodiment is different from the first exemplary embodiment in terms of provision of a stirring member 352*a* to a cleaning unit 35 for collecting the toner remaining on the intermediate transfer belt 20. FIG. 9 is a schematic cross-sectional view illustrating the configuration of the cleaning unit 35 according to the present exemplary embodiment. In the description below, the configuration of the third exemplary embodiment will be described in detail with reference to FIG. 9. The third exemplary embodiment is substantially the same as the first exemplary embodiment except for the difference in the configuration of the cleaning unit 35. Thus, in the description below, the third exemplary embodiment will be described by assigning the same reference numerals to similar configurations and control to the first exemplary embodiment and omitting the descriptions thereof.

As illustrated in FIG. 9, the cleaning unit 35 includes a cleaning blade 351, and a cleaning container 352, which temporarily accommodates the toner removed by the cleaning blade 351. The cleaning container 352 includes the stirring member 352*a*, which is rotatable in a direction indicated by an illustrated arrow R3, and a screw 352*b* (conveyance member) that conveys the toner in a longitudinal direction of the cleaning blade 351 (the width direction of the intermediate transfer belt 20) by rotating.

The stirring member 352*a* includes a flexible sheet member a1 such as polyethylene terephthalate (PET) having a thickness of approximately 80 μm, and a rotational shaft a2. The sheet member a1 is fixed to the rotational shaft a2 provided being extend over the entire area inside the cleaning container 352 in the width direction of the intermediate transfer belt 20, and is rotatable about the rotational shaft a2. The rotational shaft a2 is made of a resin member, and includes at least one flat portion Fa in parallel with a direction in which the rotational shaft a2 extends. One end side of the sheet member a1 is fixed to the flat portion Fa using a two-sided adhesive tape or the like (not illustrated). When the sheet member a1 is viewed from the direction of the rotational axis of the rotational shaft a2, the sheet member a1 is fixed to the flat portion Fa on one end side thereof and has a free end on the other end side opposite to the one end side with respect to a radial direction of a rotational track of the sheet member a1.

The rotational shaft a2 is provided with a third gear (not illustrated) for rotational driving on one end side of the shaft in the direction of the rotational axis. The rotational shaft a2 rotates in the direction indicated by the illustrated arrow R3 in FIG. 9 due to sequential transmission of a driving force from a first gear (not illustrated) disposed at a shaft end portion of the rotating counter roller 13 and a second gear (not illustrated) engaged with the first gear. Further, as illustrated in FIG. 9, the center of the rotational axis of the rotational shaft a2 is placed to be higher than the cleaning blade 351 and to be lower than the center of the rotational axis of the screw 352*b* with respect to the direction of gravitational force when the rotational shaft a2 is viewed from the direction of the rotational axis of the rotational shaft a2.

The toner removed from the intermediate transfer belt 20 by the cleaning blade 351 after passing the secondary transfer portion N2 is temporarily accommodated inside the cleaning container 352. At this time, the toner temporarily accommodated inside the cleaning container 352 is deposited around a cleaning portion CL where the cleaning blade 351 and the intermediate transfer belt 20 come in contact with each other. Then, the toner deposited around the cleaning portion CL is pushed out by the screw 352*b* to be supplied while being stirred by the rotating stirring member 352*a*.

The screw 352*b* includes a helical conveyance portion b1 for conveying the toner supplied due to the rotation of the stirring member 352*a* in the direction of the rotational axis of the screw 352*b* (longitudinal direction). The screw 352*b* includes a fourth gear (not illustrated) for transmission of driving at an end portion thereof on a non-driving side in the direction of the rotational axis. The fourth gear (not illustrated) is engaged with the third gear (not illustrated), which drives the stirring member 352*a*, and can rotate by the driving force transmitted via the not-illustrated first gear, second gear, and third gear.

The toner moved in the longitudinal direction inside the cleaning container 352 by the screw 352*b* reaches a not-illustrated toner conveyance path provided on one end side of the cleaning container 352 in the width direction of the intermediate transfer belt 20. The toner conveyance path includes a slope slanting at an angle that is larger than an angle at which the toner drops due to its own weight, and the toner conveyed to the toner conveyance path is gravity-fed into a not-illustrated collection container due to the toner's own weight.

Next, the functions of the present exemplary embodiment will be described. An evaluation method similar to that of the first exemplary embodiment is used with respect to the functions of the present exemplary embodiment.

In the configuration according to the present exemplary embodiment, the moisture attached to the photosensitive drums 1*a* to 1*d* is moved to the intermediate transfer belt 20 side due to the circumferential speed difference between the photosensitive drums 1*a* to 1*d* and the intermediate transfer belt 20, and is scraped by the cleaning blade 351 in contact with the intermediate transfer belt 20 and is collected into the cleaning container 352. The stirring member 352*a* conveys the deposited toner to the screw 352*b* together with the collected moisture while stirring it, thereby being able to prevent or reduce the deposition of the toner containing the moisture around the cleaning blade 351.

If excessive moisture is mixed into the toner deposited around the cleaning blade 351, highly viscous toner containing the moisture may be accumulated around the cleaning portion CL by a large amount. The viscosity of the toner may exceed a predetermined threshold to be considered highly viscous. The highly viscous toner is highly adhesive to the intermediate transfer belt 20, and thus may impair cleaning performance using the cleaning blade 351. Such a phenomenon easily occurs particularly when a state of the condensation is severe and excessive moisture is attached to the photosensitive drums 1*a* to 1*d* or when a large amount of toner is deposited around the cleaning blade 351. On the other hand, in the configuration according to the present exemplary embodiment, provision of the stirring member 352*a* allows the image forming apparatus 100 to prevent or reduce the deposition of the toner containing the moisture around the cleaning blade 351 and thus to prevent or reduce the deterioration of the cleaning performance using the cleaning blade 351.

In the above-described manner, in the present exemplary embodiment, advantageous effects similar to the first exemplary embodiment can be acquired. Furthermore, the provision of the stirring member 352*a* to the cleaning unit 35 allows the image forming apparatus 100 to prevent or reduce the deterioration of the cleaning performance even under a severe condition such as when excessive condensation has occurred.

The first to third exemplary embodiments have been described regarding the configuration of the intermediate transfer belt including the two layers, namely, the base layer and the surface layer. However, the layer structure of the intermediate transfer belt is not limited thereto and, for example, the intermediate transfer belt may be a single-layered belt including only the base layer or may be a multi-layered belt including three or more layers.

The first to third exemplary embodiments have been described regarding the intermediate transfer-type image forming apparatus 100 using the intermediate transfer belt, but the image forming apparatus is not limited thereto. A direct transfer-type image forming apparatus including a conveyance belt that conveys the transfer material P can also obtain advantageous effects similar to those of the first to third exemplary embodiments by employing the configuration and the control described in the first to third exemplary embodiments.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-205594, filed Nov. 13, 2019, which is hereby incorporated by reference herein in its entirety.

What is claimed is:

1. An image forming apparatus comprising:

a photosensitive drum configured to bear a toner image on the photosensitive drum;

a charging roller configured to charge a surface of the photosensitive drum;

an intermediate transfer belt configured to be movable, wherein the intermediate transfer belt forms a first transfer portion in contact with the photosensitive drum;

a development unit including a development roller in contact with the photosensitive drum and configured to develop an electrostatic latent image formed on the photosensitive drum using toner, wherein the toner image borne on the photosensitive drum is transferred onto the intermediate transfer belt at a position where the first transfer portion is formed, and toner from the toner image remaining on the photosensitive drum after passing through the position is collected by the development unit;

a secondary transfer roller configured to transfer the toner image on the intermediate transfer belt onto a recording material at a second transfer portion;

a collection unit disposed downstream of the second transfer portion and upstream of the first transfer portion in a movement direction of the intermediate transfer belt, wherein the collection unit includes a cleaning blade in contact with the intermediate transfer belt and is configured to collect toner remaining on the intermediate transfer belt adjacent to the cleaning blade;

a detector configured to detect a first environment inside the image forming apparatus and a second environment around a location at which the image forming apparatus is set up;

a transfer power source configured to apply a transfer voltage to the intermediate transfer belt at the first transfer portion; and a controller configured to control the transfer power source, wherein the controller controls to perform a first operation to form the toner image onto the recording material at the second transfer portion in a state of driving of the intermediate transfer belt in such a manner that the intermediate transfer belt moves at a second surface speed which is faster than a first surface speed, while driving the photosensitive drum in such a manner that the photosensitive drum rotates at the first surface speed, and to perform a second operation to rotate the intermediate transfer belt and the photosensitive drum in contact with each other, the second operation being different from the first operation, wherein, based on the first environment and the second environment of detection by the detector, the controller controls to perform predetermined control to move the development roller to separate the development roller from the photosensitive drum and drive the intermediate transfer belt in such a manner that the intermediate transfer belt moves at the second surface speed while driving the photosensitive drum in such a manner that the photosensitive drum rotates at the first surface speed in a state where the photosensitive drum is in contact with the intermediate transfer belt, and wherein the controller controls a potential difference between a surface potential of the photosensitive drum and the transfer voltage in the second operation to be smaller than a potential difference between the surface potential of the photosensitive drum and the transfer voltage in the first operation at the first transfer portion.

2. The image forming apparatus according to claim 1, wherein the controller controls to perform the predetermined control for a predetermined time in a non-image-forming period in which the toner image is not developed on the photosensitive drum by the development unit.

3. The image forming apparatus according to claim 1, wherein the detector detects a temperature around the location at which the image forming apparatus is set up, and wherein the controller controls to perform the predetermined control based on a change in the temperature around the location at which the image forming apparatus is set up detected by the detector.

4. The image forming apparatus according to claim 1, wherein a ratio of the second surface speed to the first surface speed is 105% or lower.

5. The image forming apparatus according to claim 1, wherein the intermediate transfer belt includes a plurality of grooves on a surface of the intermediate transfer belt in contact with the photosensitive drum, and wherein the plurality of grooves is formed along the intermediate transfer belt movement direction and is arranged in a width direction of the intermediate transfer belt perpendicular to the intermediate transfer belt movement direction.

6. The image forming apparatus according to claim 5, wherein the plurality of grooves is formed along the intermediate transfer belt movement direction in a slanted manner at an angle θ with respect to the intermediate transfer belt movement direction, and an interval I between grooves adjacent to each other in the intermediate transfer belt width direction satisfies the following inequality:

$$I \leq L \times \tan\theta,$$

where L represents a circumferential length in the intermediate transfer belt movement direction.

7. The image forming apparatus according to claim 1, wherein the intermediate transfer belt includes a plurality of protrusion portions on a surface of the intermediate transfer belt in contact with the photosensitive drum, and wherein the plurality of protrusion portions is formed along the intermediate transfer belt movement direction and is arranged in a width direction of the intermediate transfer belt perpendicular to the intermediate transfer belt movement direction.

8. The image forming apparatus according to claim 1, wherein the intermediate transfer belt includes a plurality of layers having a base layer, which is a thickest layer among the plurality of layers, and having a surface layer, which is formed on a surface of the intermediate transfer belt in contact with the photosensitive drum.

9. The image forming apparatus according to claim 1, wherein the cleaning blade is a first cleaning blade, and a second cleaning blade, in contact with the photosensitive drum and used to collect the toner remaining on the photosensitive drum, is not provided on a downstream side of the first transfer portion and an upstream side of a position where a charger and the photosensitive drum face each other in a rotational direction of the photosensitive drum.

10. The image forming apparatus according to claim 1, wherein the cleaning blade includes a cleaning blade configured to come in contact with the intermediate transfer belt from a counter direction with respect to the intermediate transfer belt movement direction.

11. The image forming apparatus according to claim 1, wherein the collection unit includes a rotational and flexible stirring member configured to stir the toner collected by the cleaning blade.

12. The image forming apparatus according to claim 1, wherein, in a case where condensation is determined as having occurred inside the image forming apparatus based on a result of detection by the detector, the controller controls to perform the predetermined control (i) to separate the development roller from the photosensitive drum and (ii) to drive the photosensitive drum and the intermediate transfer belt, thereby moving moisture attached to the photosensitive drum from the photosensitive drum to the intermediate transfer belt and then (iii) to collect the moisture from the intermediate transfer belt into the collection unit adjacent to the cleaning blade.

13. The image forming apparatus according to claim 1, wherein the controller controls not to apply the transfer voltage in the second operation.

* * * * *